US011781834B2

(12) United States Patent
Teetzel et al.

(10) Patent No.: US 11,781,834 B2
(45) Date of Patent: Oct. 10, 2023

(54) FIRE CONTROL SYSTEM

(71) Applicant: Wilcox Industries Corp., Newington, NH (US)

(72) Inventors: James W. Teetzel, Portsmouth, NH (US); Gary M. Lemire, Lee, NH (US)

(73) Assignee: Wilcox Industries Corp., Newington, NH (US)

( * ) Notice: Subject to any disclaimer, the term of this patent is extended or adjusted under 35 U.S.C. 154(b) by 82 days.

(21) Appl. No.: 17/502,820

(22) Filed: Oct. 15, 2021

(65) Prior Publication Data

US 2022/0120533 A1 Apr. 21, 2022

Related U.S. Application Data

(60) Provisional application No. 63/092,998, filed on Oct. 16, 2020.

(51) Int. Cl.

| | |
|---|---|
| ***F41G 1/48*** | (2006.01) |
| ***F41G 3/06*** | (2006.01) |
| ***F41F 1/00*** | (2006.01) |
| ***F41G 1/473*** | (2006.01) |
| ***G06G 7/80*** | (2006.01) |

(52) U.S. Cl.

CPC ..... *F41G 1/48* (2013.01); *F41F 1/00* (2013.01); *F41G 1/473* (2013.01); *F41G 3/06* (2013.01); *G06G 7/80* (2013.01)

(58) Field of Classification Search

CPC .... F41G 1/48; F41G 1/473; F41G 3/06; F41F 1/00; G06G 7/80

USPC ..... 235/404

See application file for complete search history.

(56) References Cited

U.S. PATENT DOCUMENTS

| | | | |
|---|---|---|---|
| 8,047,118 | B1 | 11/2011 | Teetzel et al. |
| 8,100,044 | B1 | 1/2012 | Teetzel et al. |
| 8,561,518 | B2 | 10/2013 | Teetzel et al. |
| 9,506,723 | B2 | 11/2016 | Teetzel et al. |
| 9,857,143 | B2 | 1/2018 | Teetzel et al. |
| 2012/0043381 | A1 | 2/2012 | Teetzel et al. |
| 2014/0110482 | A1 | 4/2014 | Bay |
| 2016/0010949 | A1 | 1/2016 | Teetzel et al. |
| 2017/0176142 | A1 | 6/2017 | Zhang et al. |
| 2017/0299330 | A1 | 10/2017 | Teetzel et al. |

OTHER PUBLICATIONS

International Search Report and Written Opinion dated Jun. 7, 2022, received in PCT/US2021/055254.

*Primary Examiner* — Daniel A Hess

(74) *Attorney, Agent, or Firm* — McLane Middleton, Professional Association

(57) ABSTRACT

A fire control system comprises a fixed base and a sight assembly rotatably attached to the fixed base. The sight assembly includes an optical range finder for calculating a distance to a selected target and a camera having a zoom lens assembly and an optical sensor for generating an image signal representative of a target scene including a selected target. The zoom lens assembly includes a zoom controller and zoom lens optical elements, wherein the zoom controller is configured to change a magnification of the zoom lens optical elements responsive to a calculated distance to the selected target. In a further aspect, a method for imaging a target is provided.

15 Claims, 13 Drawing Sheets

FIRE CONTROL SYSTEM

CROSS REFERENCE TO RELATED APPLICATION

This application claims the priority benefit of U.S. provisional application No. 63/092,998 filed Oct. 16, 2020. The aforementioned application is incorporated herein by reference in its entirety.

BACKGROUND

This application discloses a fire control system for projectile weapons and, more particularly, a fire control system with zoom optics and high-resolution display. The present development is particularly advantageous for use with firearms or artillery that launch or fire projectiles at relatively high elevation angles. The present disclosure will be made herein primarily by way of reference to the preferred embodiment wherein the projectile is a grenade fired by a grenade launcher, such as a stand alone grenade launcher or grenade launcher that is attachable to a military or assault rifle such as an M-16 assault rifle, M-4 Carbine, or the like. However, the present development is not limited to such and can be used with any type of firearm or artillery that launches a projectile with a known trajectory. The terms "firearm" and "artillery" as used herein are intended to encompass all manner of weaponry, which may be handheld weapons, shoulder launched weapons, and crew served weapon platforms, including without limitation, guns such as handguns and rifles, heavy caliber guns, grenade launchers, cannons, howitzers, mortars, rocket launchers, shoulder launched rocket and missile delivery systems, and the like.

SUMMARY

In one aspect, a fire control system, comprises a fixed base section having a fastener for providing a rigid connection of the fixed base section to a weapon and a sight assembly rotatably attached to the fixed base section and rotatable about a transverse axis which extends in a direction which is generally transverse to a longitudinal axis of a barrel of the weapon. The sight assembly includes an optical range finder for calculating a distance to a selected target, the optical range finder including an optical emitter for sending an optical signal to the selected target and an optical detector for detecting the signal reflected from the selected target. The sight assembly also includes a camera, the camera including a zoom lens assembly and an optical sensor, the camera configured to generate an image signal representative of a target scene including the selected target. The zoom lens assembly includes a zoom controller and zoom lens optical elements, the zoom controller configured to change a magnification of the zoom lens optical elements. The sight assembly further includes a display configured to receive the image signal representative of the target scene and display a target scene image in human-viewable form. A processor assembly includes a processor and an associated computer readable memory encoded with executable instructions. The processor is configured, upon execution of the executable instructions, to receive input representative of the distance to the selected target and calculate a trajectory angle of the weapon based on the distance to the selected target whereby the weapon will launch a projectile a distance that corresponds to the distance to the selected target when the barrel of the weapon is aligned with the trajectory angle. The processor is further configured, upon execution of the executable instructions, to operate the zoom controller to change the magnification of the target scene image in proportion to a calculated distance to the selected target.

In a more limited aspect, the processor is configured, upon execution of the executable instructions, to operate the zoom controller to change the magnification of the target scene image to a maximum magnification level when the ranged target distance is greater than a first, upper threshold distance and a minimum magnification level when the ranged target distance less than a second, lower threshold distance. The processor is further configured, upon execution of the executable instructions, to operate the zoom controller to change the magnification of the target scene image to a magnification level between the maximum and minimum magnification levels in direct proportion to the ranged target distance when the ranged target distance between the first and second threshold distances.

In another more limited aspect, the display is an organic light-emitting diode (OLED) display.

In yet another more limited aspect, the sight assembly is rotatable between 0 and 45 degrees with respect to the fixed base portion.

In still another more limited aspect, the display is configured to overlay one or more indicia on the target scene image.

In another more limited aspect, the one or more indicia is selected from the group consisting of battery power indicia, range to target indicia, laser status indicia, reticle indicia, cant angle indicia, zoom magnification indicia, and any combination thereof.

In another more limited aspect, the reticle indicia comprises one or both of a bore sight reticle which is bore sighted to the weapon and a disturbed reticle having a variable position which is automatically adjusted based on range and ballistics computations from the processor.

In another more limited aspect, the fastener is selectively attachable to a left side of the fixed base portion and a right side of the fixed base portion.

In another more limited aspect, the processor is configured to selectively store digital still images of the target scene in the memory.

In another more limited aspect, the fire control system further comprises a communications interface.

In another more limited aspect, the communications interface is selected from the group consisting of Bluetooth interface, B-Tac interface, and Wi-Fi interface.

In another more limited aspect, a library of target images is stored in the memory and viewable on the display.

In another more limited aspect, facial recognition software is stored in the memory and executable by the processor for recognizing persons appearing in the target scene image.

In another aspect, a method for imaging a target comprises providing a fire control system, the fire control system comprising a fixed base section having a fastener for providing a rigid connection of the fixed base section to a weapon. A sight assembly is rotatably attached to the fixed base section and rotatable about a transverse axis which extends in a direction which is generally transverse to a longitudinal axis of a barrel of the weapon. The sight assembly includes an optical range finder for calculating a distance to a selected target, the optical range finder including an optical emitter for sending an optical signal to the selected target and an optical detector for detecting the signal reflected from the selected target. The sight assembly also includes a camera, the camera including a zoom lens assembly and an optical sensor, the camera configured to generate an image signal representative of a target scene including the selected target. The zoom lens assembly includes a zoom controller and zoom lens optical elements, the zoom controller configured to change a magnification of the zoom lens optical elements. The sight assembly further includes a display configured to receive the image signal representative of the target scene and display a target scene image in human-viewable form. A processor assembly includes a processor and an associated computer readable memory encoded with executable instructions, the processor configured, upon execution of the executable instructions, to receive input representative of the distance to the selected target and calculate a trajectory angle of the weapon based on the distance to the selected target whereby the weapon will launch a projectile a distance that corresponds to the distance to the selected target when the barrel of the weapon is aligned with the trajectory angle. The processor is configured, upon execution of the executable instructions, to operate the zoom controller to change the magnification of the target scene image in proportion to a calculated distance to the selected target. A distance to the target is calculated using the optical range finder and a target scene image is captured using the camera. A zoom control signal for controlling a position of the zoom optical elements in the zoom lens assembly is generated and the magnification of the target scene image on the display is changed in response to the distance to the target.

In a more limited aspect, the sight assembly is rotated about the transverse axis with respect to the fixed base section by an angle which corresponds to the trajectory angle and an optical axis of the sighting assembly is aligned with the target to align the barrel of the weapon with the trajectory angle.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
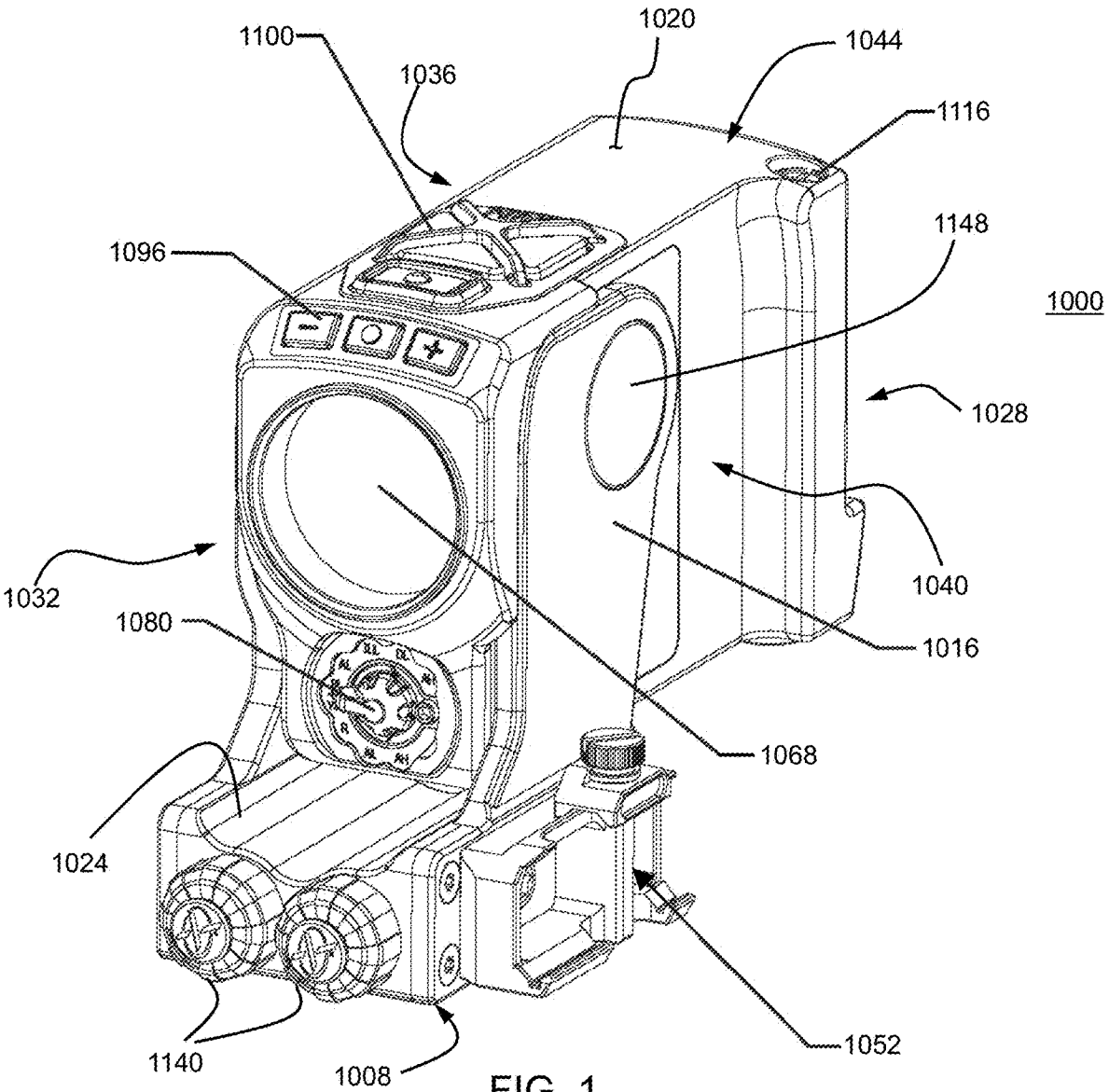
FIG. 1 is an isometric view, taken generally from the rear and right side, of an exemplary fire control system herein.

Referring to the drawing FIGS. 1-13, wherein like reference numerals refer to like or analogous components throughout the several views, an exemplary fire control system (FCS), designated generally as 1000, is shown. The fire control system 1000 includes a main body 1004 pivotally attached to a base module 1008. The base 1004 includes opposing left and right vertically extending pivot arms 1012 (see FIG. 1) and 1016 (see FIG. 2), respectively. The main body 1004 includes a housing 1020 enclosing the internal components thereof. The base 1008 includes a housing 1024 enclosing the internal components thereof and defining a support bridge 1014 between the pivot arms 1012 and 1016.

Figure 4:
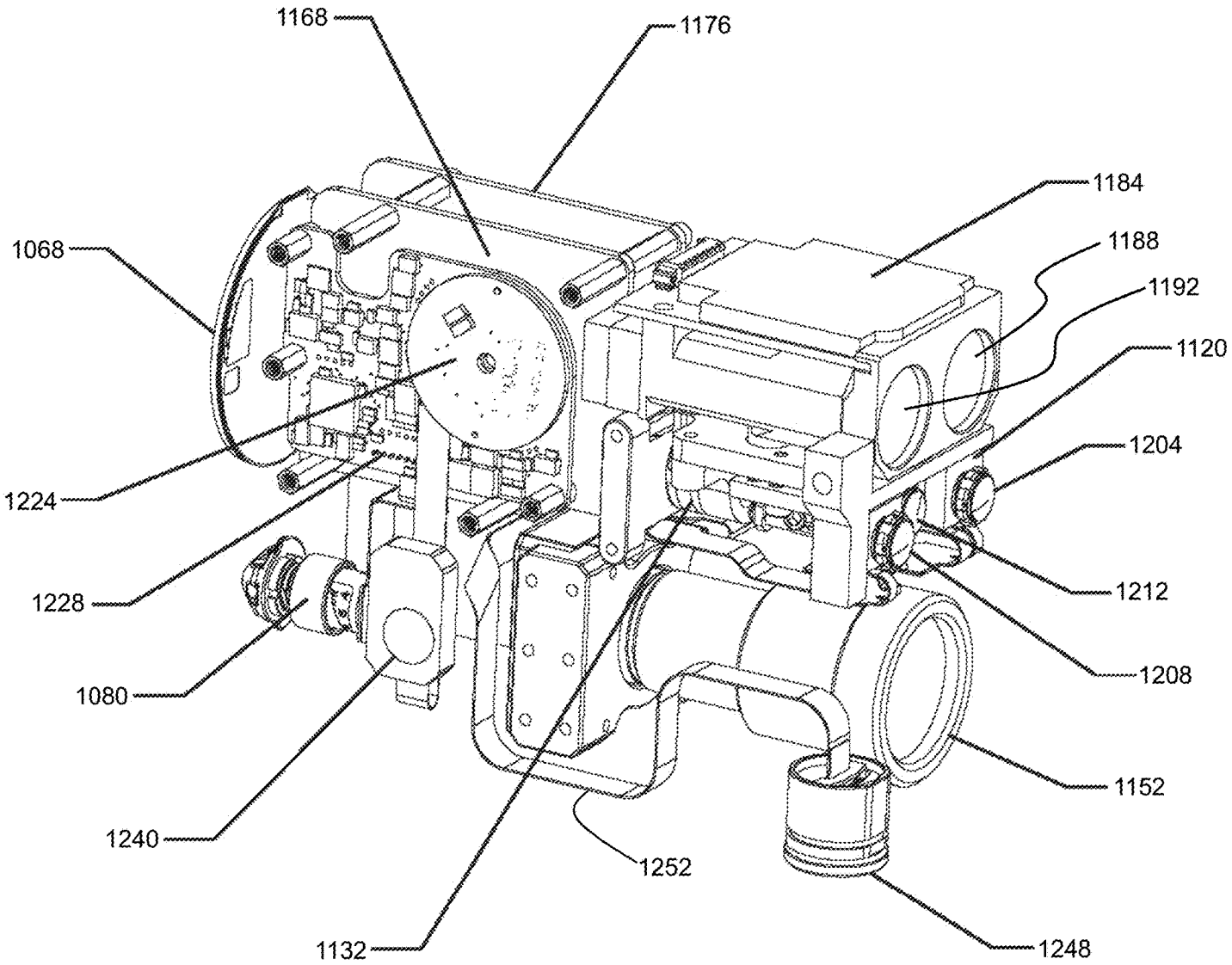
FIG. 4 is a generally left side isometric view of the fire control system appearing in FIG. 1 with the housing removed for ease of exposition.
Figure 5:
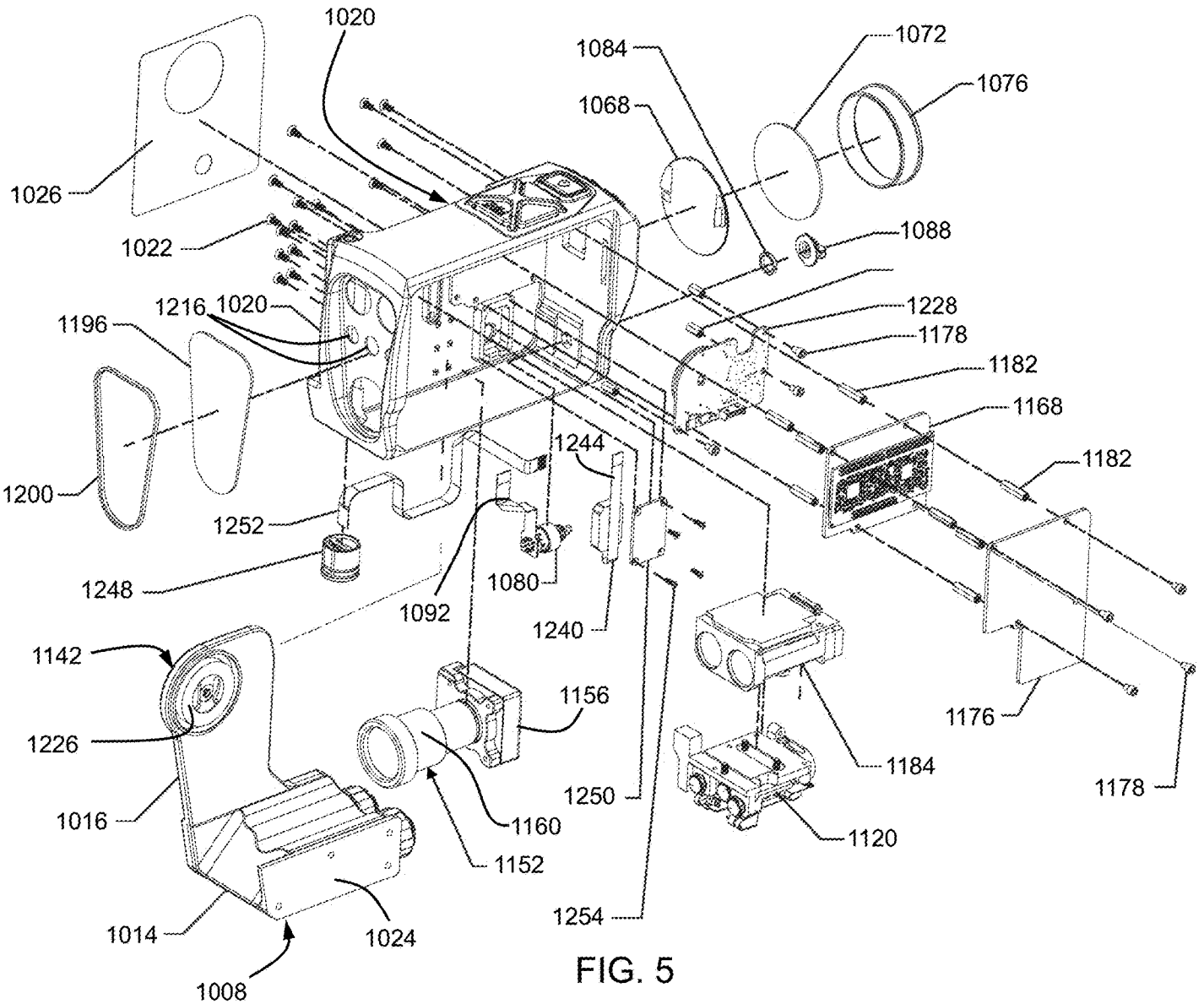
FIG. 5 is an exploded isometric view of the fire control system shown in FIG. 1, taken generally from the front and left side.

As used herein, terms denoting direction or orientation, such as left, right, front, rear, upper, lower, horizontal, vertical, etc., are taken from the perspective of an operator facing a rear or viewing side of the unit 1000 when the unit is mounted on a weapon and in the operational position. A front side 1028 of the unit 1000 is disposed opposite a rear side 1032 thereof. A left side 1036 of the unit 1000 is disposed opposite a right side 1040 thereof. Opposite upper and lower surfaces 1044 and 1048, respectively, are bounded by the generally vertically-extending front, rear, left and right surfaces 1028, 1032, 1036, and 1040, respectively. In operation, the user views the rear side 1032 of the unit 1000. The front side 1028, as best seen in FIGS. 4 and 5, is opposite the rear side 1032 and faces away from the user during operation, toward the selected target.

Figure 3:
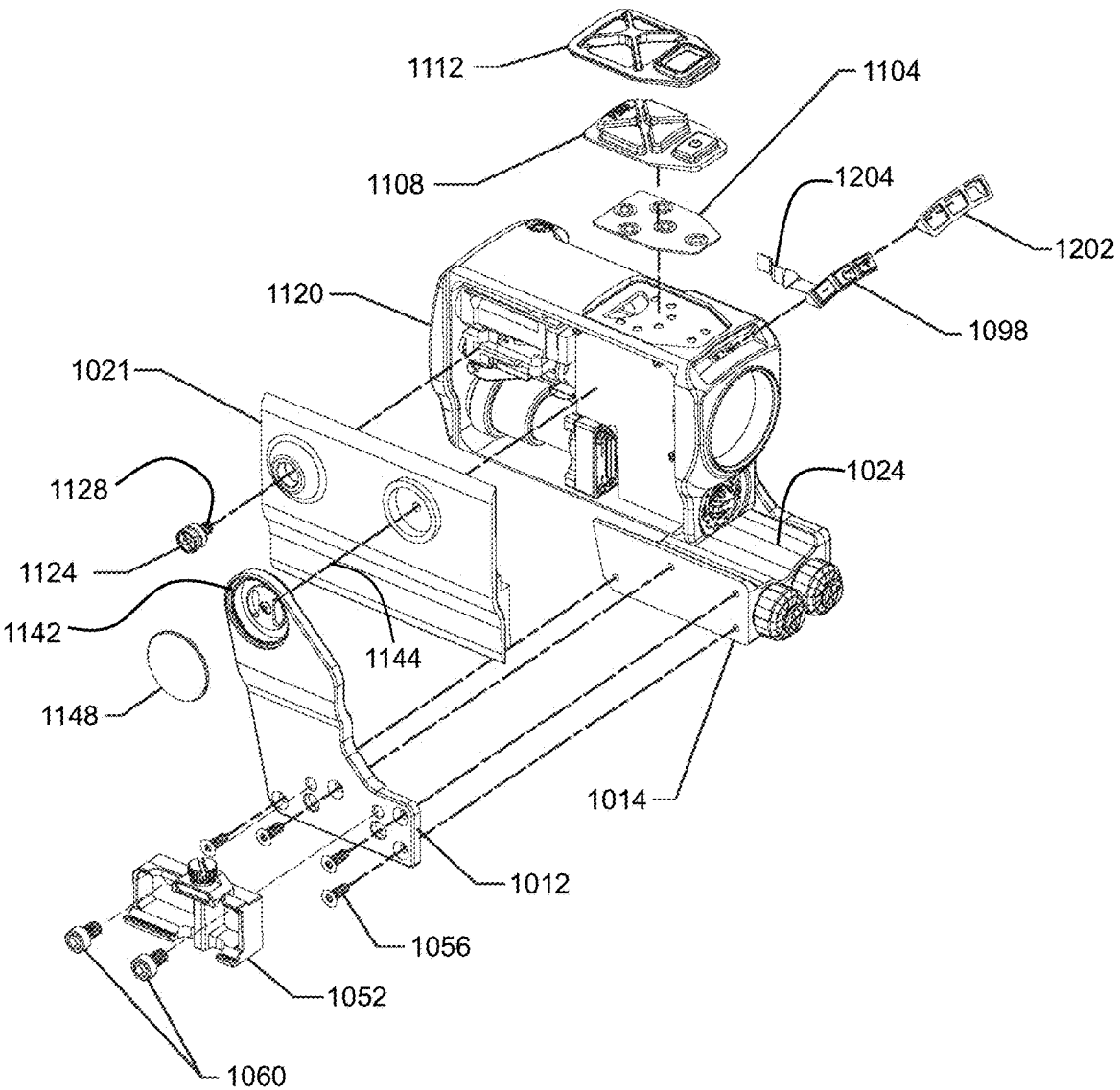
FIG. 3 is a partially exploded isometric view, of the fire control system shown in FIG. 1.

As illustrated in FIG. 1, the right side of the base 1008 includes a weapon rail interface, such as a rail clamp assembly 1052 removably attached thereto via fasteners 1056 and 1060 (see FIG. 3). When the rail clamp assembly 1052 is attached to the right side of the base 1008, it adapts the unit 1000 be attached to the left side of a weapon 1064 (see FIGS. 6 and 7), such as a grenade launcher (see FIGS. 6 and 7). In the illustrated embodiment, the rail clamp assembly 1052 is removable and can alternatively be mounted on the left side of the base 1008 for mounting the unit 1000 on the right side of the weapon 1064, thereby allowing for ambidextrous use of the unit 1000. The base 1008 is parallel to an axis 1232 of the barrel 1236 of the weapon 1064.

A display 1068 is disposed on the rear side 1036 of the main body 1004. The display 1068 is preferably a high-resolution display, more preferably an organic light-emitting diode (OLED) display. A display window 1072 is disposed over the display 1068 and retained in place with a display window retainer 1076. A mode select rotary switch 1080 is also disposed on the rear surface of the main body 1004 for selecting an operational mode of the unit 1000. The rotary switch 1080 is retained to the housing 1020 with a retainer 1084 and includes a manually actuatable selector knob 1088.

The rotary switch 1080 is operably coupled to a data bus 1086 via a circuit substrate 1092.

In certain embodiments, the unit 1000 can be utilized as a control system for Air Bursting Munitions, as follows. When direct line of sight to a target is not possible, a reference object close to the intended target is ranged to get the ballistic solution for airburst distance. This range can be manually increased or decreased as necessary and locked in utilizing a rear-facing three-button keypad assembly 1096 provided on the rear side 1032 of the main body 1004. A five-button activation control keypad assembly 1100 is provided on the upper side 1044 of the main body 1004 for controlling operation of the unit 1000.

As best seen in FIG. 3, the five button keypad assembly 1100 includes a circuit board 1104, a keypad with manually depressible keys or buttons 1108 and a frame 1112. The three-button keypad assembly 1096 includes a three-button switch module 1098 and a frame 1202 and is coupled to the data bus 1086 via a circuit substrate 1204.

Figure 2:
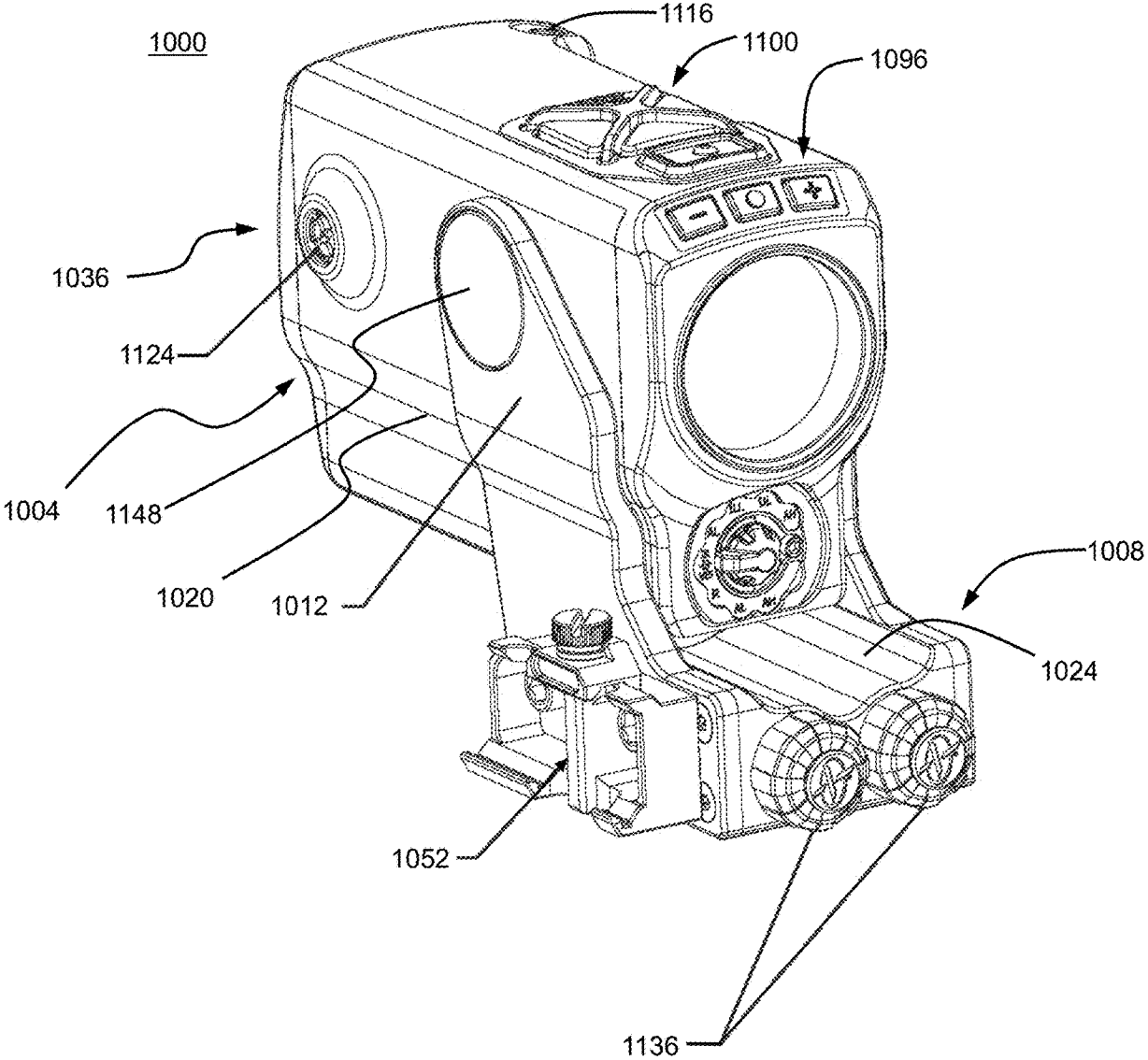
FIG. 2 is an isometric view of the fire control system appearing in FIG. 1, taken generally from the front and left side.

An elevation adjustment mechanism 1116 is disposed on the upper side of the main body 1004 for vertically adjusting the pointing direction of a pointing and illumination laser suite 1120 up or down in relation to the housing 1020 to provide an elevation adjustment for bore sighting the unit 1000 to a weapon. As best seen in FIGS. 2 and 3, a windage adjustment mechanism 1124 is disposed on the left side 1036 of the main body 1004 for horizontally adjusting the pointing direction of the entire laser suite 1120 in relation to the housing 1020 to provide a windage adjustment for bore sighting the unit 1000 to a weapon. The elevation and windage adjusters 1116 and 1124, respectively, bear against the laser suite 1120 and are rotatable to selectively advance or retract a plunger or bearing member 1128, thereby fine tuning the aiming direction of the laser suite 1120 which is configured to pivot in the horizontal and vertical directions about a flexure 1132 in response to adjustment of the elevation and windage adjusters. The windage adjuster is disposed on a removable side housing panel 1021.

A power source 1136 is received within an interior compartment in the base 1008. Removable caps 1140 are disposed in the rear side of the base 1008 to provide access to the battery compartment. In certain embodiments, the power source comprises two batteries, such as two AA batteries or two CR123 COTS lithium batteries. In certain embodiments, the power source 1136 is controlled through a switching circuit to use one battery as a primary source and the other battery a secondary source. The pivot arms 1012, 1016 include pivot assemblies 1142 defining a pivot axis 1144. Pivot covers 1148 are disposed over the pivot assemblies 1142.

Figure 13:
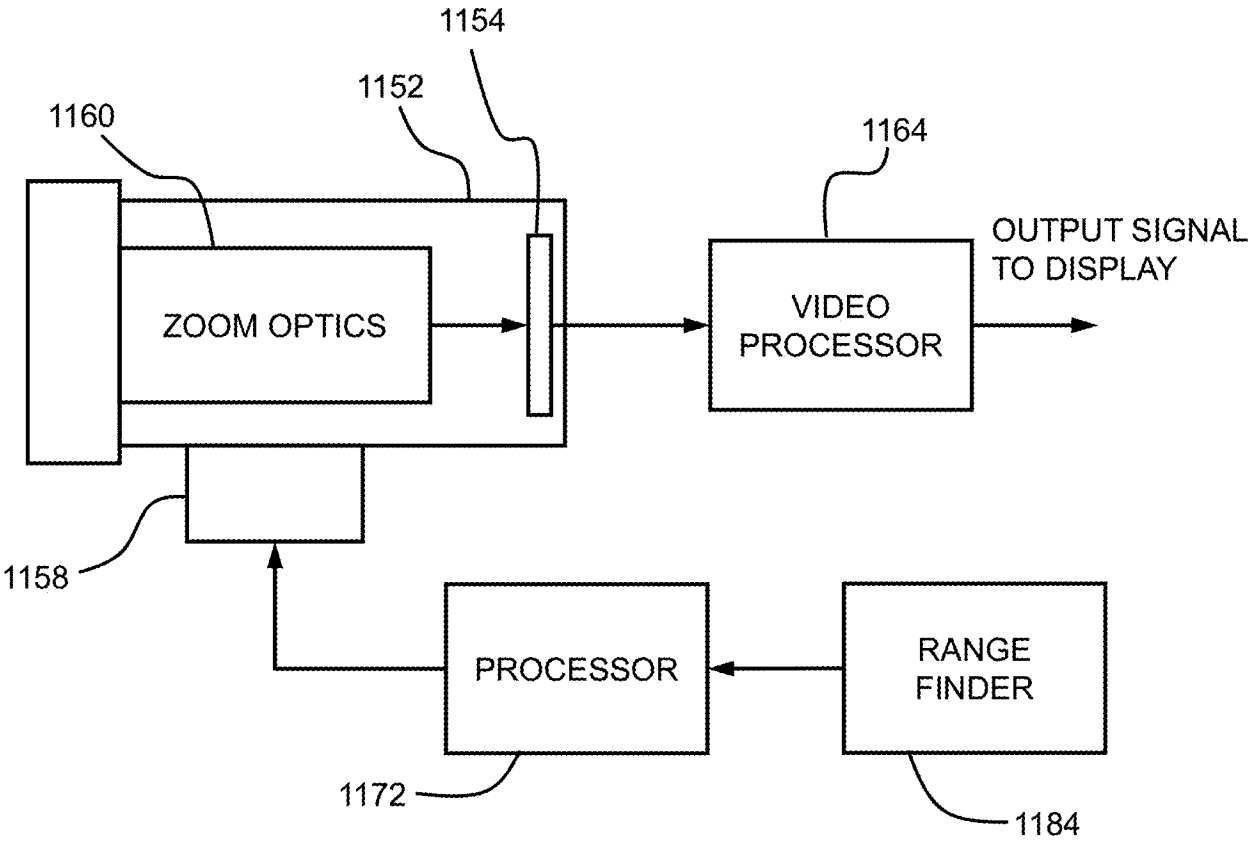
FIG. 13 is a functional block diagram of an exemplary zoom control system herein.

Referring now to FIGS. 4 and 13, and with continued reference to FIGS. 1-13, a high-resolution camera 1152 is disposed in the main body 1004 and includes a camera body 1156, which includes a photosensor array 1154 such as a CCD array or the like and a zoom lens assembly 1160. Images from the camera 1152 are processed by a video processor 1164 on a video and logic circuit board 1168 and displayed in human viewable form on the display 1068. The camera may be, for example, a visual light camera or an infrared camera. A zoom controller 1158 is mechanically coupled to the zoom optics 1160 and is communicatively coupled to a processor 1172. The zoom distance of the zoom lens assembly 1060 is controlled by the processor 1172, which resides on a main control circuit board 1176 and has an associated memory 1180. The zoom lens assembly 1160 is synchronized under the control of the processor 1172 to zoom in or out based on the distance to an identified target as determined by an onboard optical rangefinder 1184, wherein the zoom or magnification level increases proportionally with increasing distance to the target. In certain embodiments, the optical range finder 1184 is capable of ranging a man size target at a minimum of 2000 meters. In certain embodiments, the movement of the zoom optical elements may be controlled by a servomechanism, gimbal system, stepper motor, encoded DC motor, or other electromechanical element that produces accurate, incremental, bi-directional movements. In some embodiments, as the zoom level is changed responsive to the target distance determined by the range finder, other camera parameters, such as focus, aperture, depth of field, and so forth are also adjusted accordingly. In certain embodiments, the zoom magnification level is adjusted based on the ranged target distance as follows. When the ranged target distance is greater than a first, upper threshold distance, the zoom/magnification level is increased to the maximum magnification level of the zoom assembly. When the ranged target distance is less than a second, lower threshold distance, the zoom/magnification level is decreased to the minimum magnification level of the zoom assembly. When the ranged target distance is between the first, upper threshold distance the second, lower threshold distance, the zoom/magnification level is adjusted by the zoom controller 1158 to a magnification level in direct proportion to the ranged target distance.

By adjusting the zoom level of the zoom lens 1156, based on the distance to the target determined by the rangefinder 1184, the user can engage close targets as well as targets located far away (e.g., two thousand meters away) automatically. In certain embodiments, the zoom level can also be controlled by the operator manually. The ability to engage far away targets is advantageous over the inherent design of conventional grenade launchers which commonly use 1× magnification reflex sights that are typically used out to a distance of 400 meters. At distances beyond 400 meters, the grenadier begins to lose his ability to identify the target and the placement of the round when fired. While standard telescopic weapon scopes can provide greater magnification, the eye relief for such scopes, are typically in the range of 1-2 inches. An advantage of the present development is that the eye relief to the display is relatively large, e.g., up to 18 inches or more, thereby allowing the fire control system in accordance with this disclosure to be employed with a much broader range of weapon platforms.

The front side 1028 of the unit 100 includes the optical range finder 1184 including an optical transmitter 1188 with an optical source, such as a laser and preferably an infrared (IR) laser source, and an optical receiver 1192. In operation, the distance to a target is determined by measuring the time interval between the emission of an optical signal by the transmitter 1188 to the target and detection of the reflected signal by the receiver 1192. The front side 1028 of the main body 1004 includes window 1196 secured to the housing 1020 with a frame 1200. In certain embodiments, the rangefinder 1184 includes an anti-glare member, e.g., formed of a honeycomb or other collimating material to prevent off-angle reflections from reaching the range finder components.

In the depicted preferred embodiment, the laser suite assembly 1120 includes a first pointing laser 1204, a second pointing laser 1208, and an illumination laser 1212. Other numbers or configurations of lasers in the laser suite 1120 are contemplated. The lasers 1204, 1208, and 1212 include laser emitters (e.g., laser diodes) and associated lenses or other optical elements, e.g., focusing optics. In certain embodiments, the first pointing laser 1204 is a visible laser (e.g., red or green) viewable with the naked eye; the second pointing laser 1208 is an infrared laser for use with night vision goggles or other infrared imaging device; and the illuminating laser 1212 is an infrared illuminator, such as vertical cavity surface emitting laser (VCSEL) laser illuminator. The lasers 1204, 1208, and 1212 are coaligned so that the beams emitted by each are parallel to each other. The lasers 1204, 1208, and 1212 emit through aligned openings 1216 in the housing 1020.

In some embodiments, images acquired by the camera 1152 can be stored in a memory 1180 associated with the processor 1172, e.g., in a digital still image format, such as JPG, PNG, or other image file format. In this manner, still images of the target can be transmitted to other users via a wireless networking interface 1220, e.g., through Bluetooth, B-Tac, Wi-Fi, or another networking system. For example, this allows a team member that may be closer to the target to engage using a less expensive, shorter range munition to achieve the goal, e.g., an M433 HEDP Grenade vs. a "Pike" Missile. The wireless communications interface 1220 is located on the main control circuit board 1176.

The main body 1008 includes an encoder assembly 1224 residing on an encoder circuit board 1228 to generate a signal representative of the degree of rotation of the main body 1004 in relation to the base 1008, e.g., between 0 and 45 degrees. The encoder assembly 1224 may be of the type generating a pulse signal representing rotational movement of the pivot arm 1016 relative to the main body 1004. A rotating ring 1226 on the pivot arm 1016 engages the encoder assembly 1224 which generates a signal representative of relative rotation between the pivot arm 1016 and the main body 1008. In certain embodiments, the main body 1004 is manually rotated about the pivot axis 1144 until the angle is such that aiming the weapon using the display 1068 is equal to the ballistics solution trajectory angle based on distance to target and other ballistics factors.

As best seen in FIG. 5, the internal components are secured within the housing 1020 via a plurality of self-sealing threaded fasteners 1022 passing through a wall of the housing 1020. A label covering 1026 is disposed over the fastener head of the fasteners 1022. The encoder board 1228, video board 1168, and the main control board 1176 are secured within the housing and to each other in a stacked configuration using threaded fasteners 1178 and spacers or standoffs 1182

Figure 10:
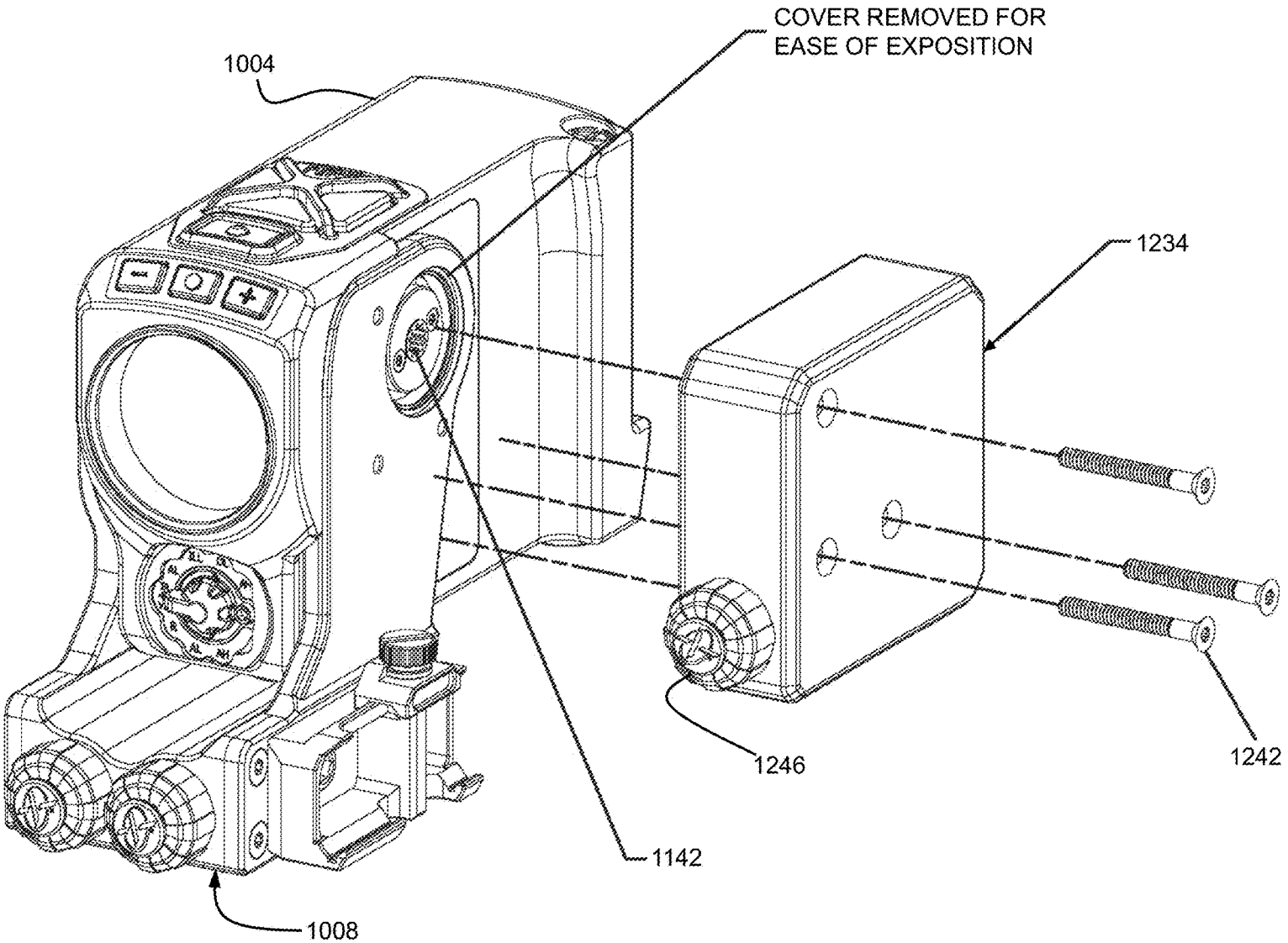
FIG. 10 illustrates an exemplary fire control system having an optional drive motor module for rotating the main body under programmed control to achieve an appropriate weapon firing attitude for a given ballistic solution.

Alternatively, in certain embodiments an optional servo-motor or drive motor 1230 is provided for automatically controlling the degree of rotation of the main body 1008 relative to the base 1008 under programmed control of the processor 1172 to provide the proper attitude of the weapon in accordance with a ballistics solution. An exemplary embodiment motorized embodiment is illustrated in FIG. 10. In such embodiments, the motor 1230 may be provided in a motor drive module 1234, which can be attached to one of the pivot assemblies 1142 (right in the embodiments shown in FIG. 10), upon removal of the corresponding pivot cover 1148. The drive assembly 1234 is secured to the pivot arm via threaded fasteners 1242. In certain embodiments, a control signal for driving the motor 1230 is provided via a cable 1238 operatively coupling the remote control data port 1248 to the motor drive pack 1234. Power to drive the motor 1230 may be provided by a dedicated power supply 1246 in the module 1234 or, alternatively, by the power supply 1136 via an electrical communication between the power supply 1136 and the motor module 1234. The motor module 1234 may use gears and/or other conventional mechanical linkages between a motor drive shaft and the main body to rotate the main body 1004 about the pivot assembly 1142 relative to the base 1008.

An environmental sensor module 1240 senses one or more environmental conditions that may affect the ballistic calculation. Exemplary environmental factors include temperature, barometric pressure, relative humidity, altitude, wind speed, and so forth. The environmental sensor module 1240 is operably coupled to the data bus 1086 via a circuit substrate 1244. In certain embodiments, a connector socket 1248 provides an electrical communication to a remote control unit, such as a remote keypad, for controlling operation of the unit 1000. The environmental sensor module 1240 is retained within the housing via a retainer plate 1250 and threaded fasteners 1254 (see FIG. 5). Additionally or alternatively, in certain embodiments, the connector socket 1248 provides a connection port, such as an RS-232 data port, for transferring data from the unit 1000 to another computer or computer-based information handling system and/or for loading or updating software instructions for storage in a memory 1180 for execution by the processor 1172. The remote connector socket 1248 is operably coupled to the data bus 1086 via a flexible circuit substrate 1252.

In operation, the fire control system 1000 is first set at a zero elevation setting (see FIG. 6), wherein the optical axis of the fire control system 1000 is bore sighted to the weapon centerline for target acquisition and ballistic calculation. In the zero elevation setting, the rangefinder 1184 is used to determine the distance to a selected target. The range calculation may be performed by the processor 1172, which is coupled to the rangefinder 1184 and other on-board components as described herein via a data bus 1086.

Figure 6:
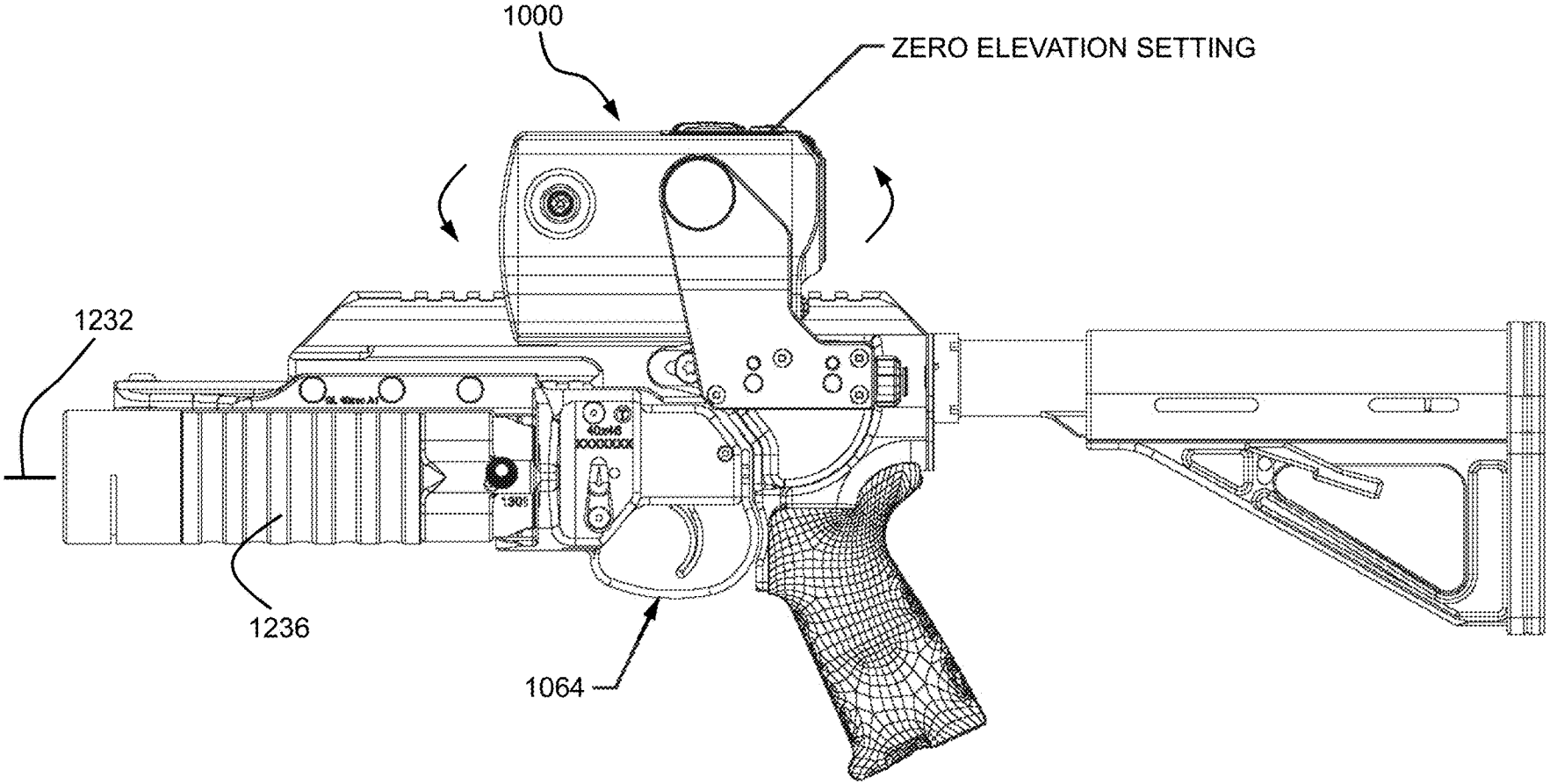
FIG. 6 is a side view of a weapon system utilizing the fire control system of FIG. 1, wherein the fire control system is shown at zero elevation for target acquisition and ballistic calculation.
Figure 7:
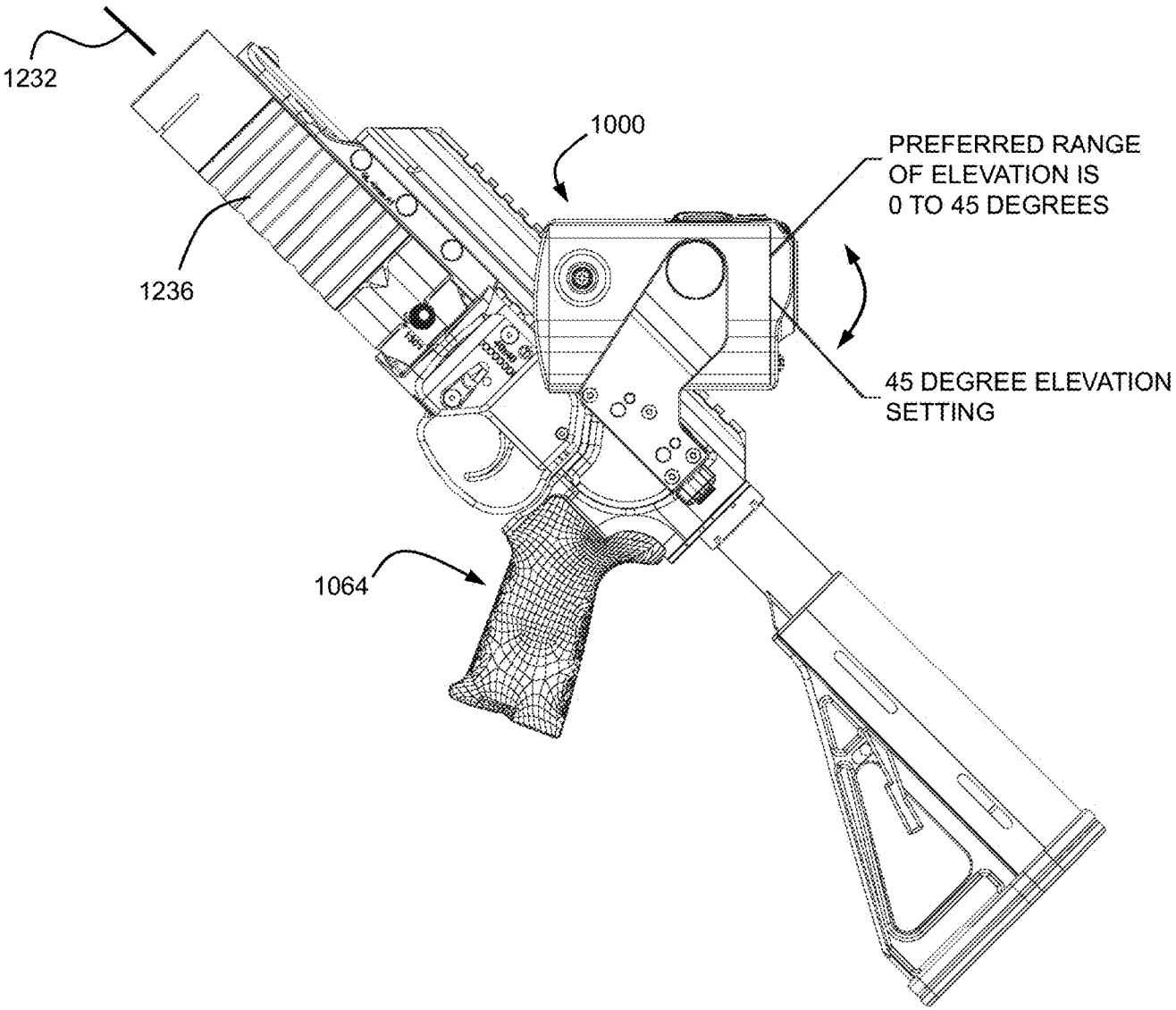
FIG. 7 is a side view of the weapon system appearing in FIG. 6, wherein the fire control system is shown at a 45-degree setting.

In the embodiment appearing in FIG. 6, the fire control system 1000 is depicted attached to a grenade launcher 1064 in standalone configuration. It will be recognized that the unit 1000 may also be used on any primary weapon with side mounting capability. It will be recognized that the application is not limited to grenade launchers in general and may be used on multiple weapon platforms, including hand held rocket delivery systems, hand held missile delivery systems, and others.

In certain embodiments, the range of rotation of the main body 1004 in relation to the base module 1008 is a range that allows the use of multiple munitions and ballistic ranges, such as zero to 60 degrees, preferably from zero to 45 degrees.

Figure 8:
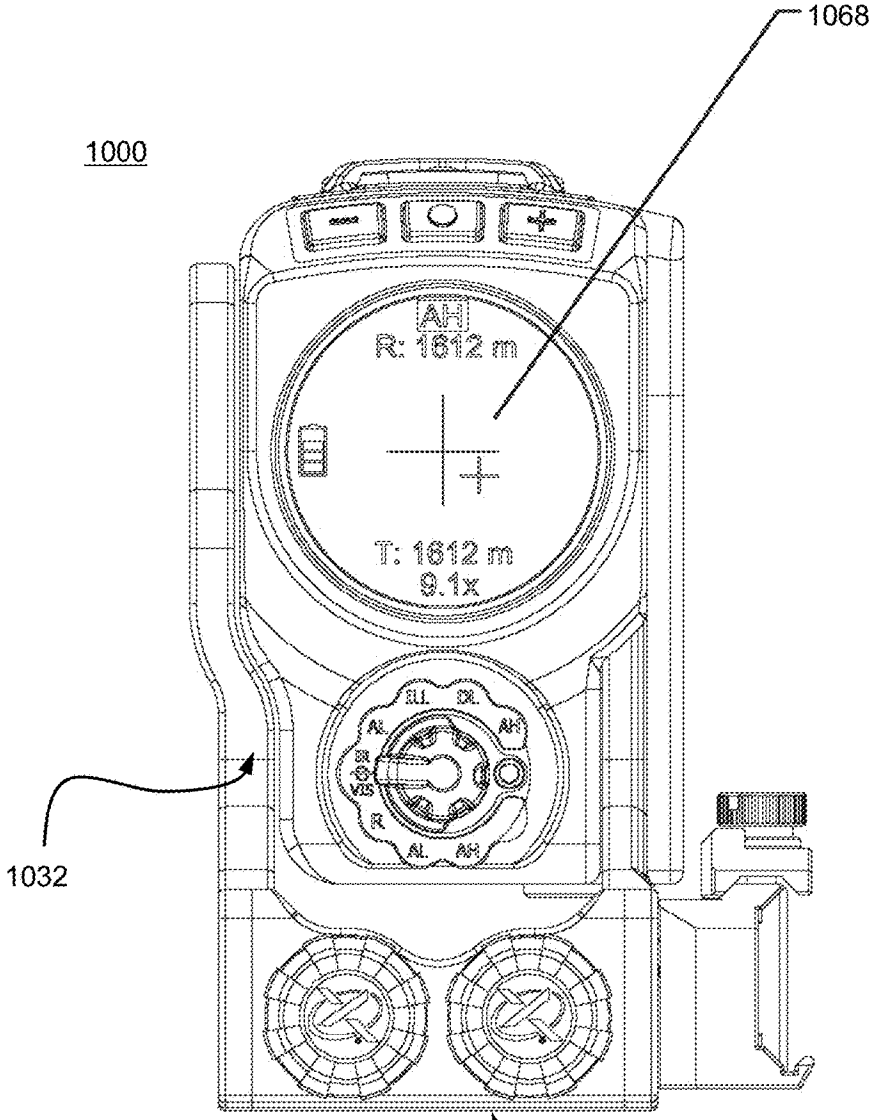
FIG. 8 is a rear elevation view of the fire control system appearing in FIG. 1, illustrating an exemplary on-screen user interface.
Figure 9:
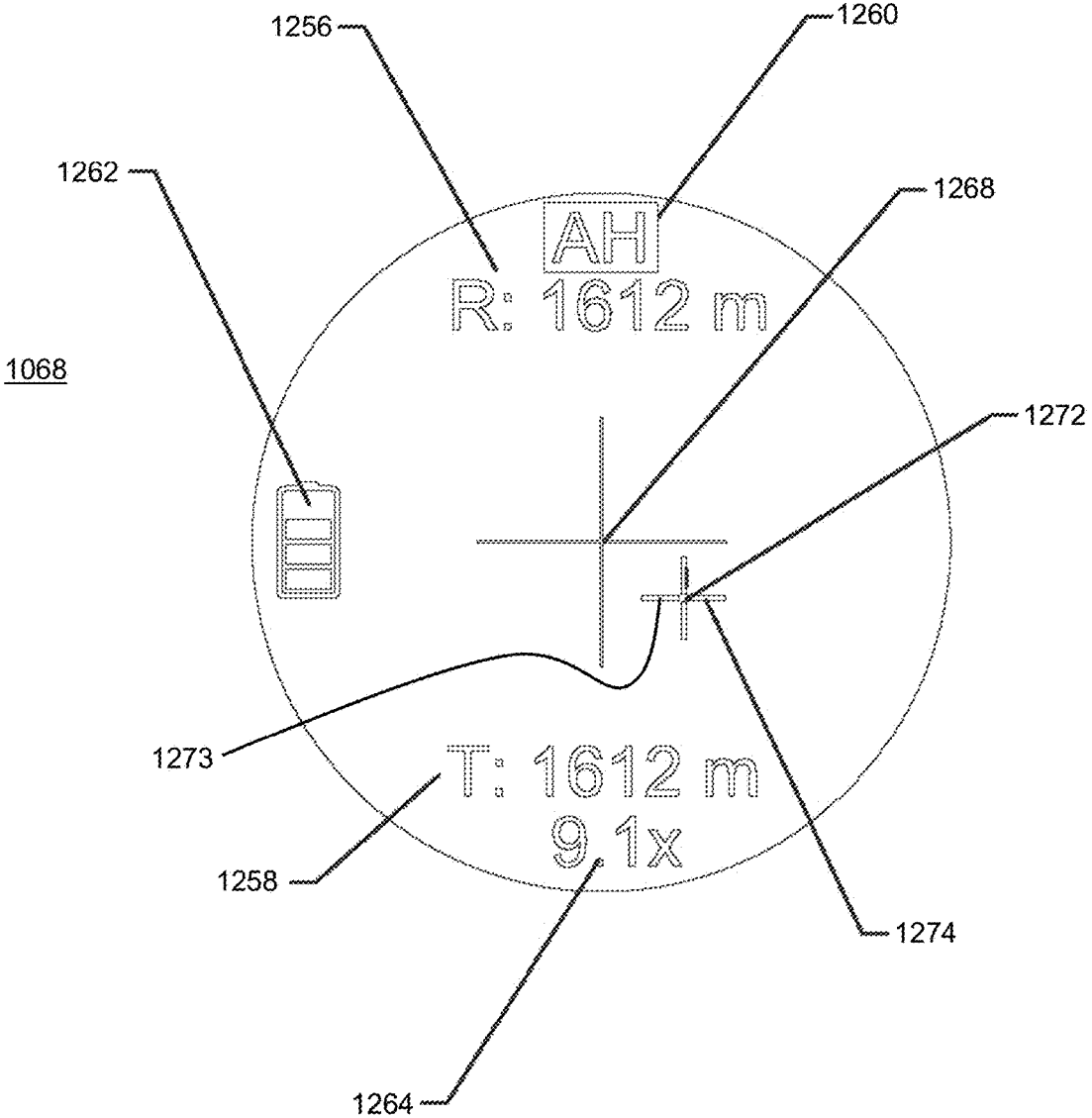
FIG. 9 is an enlarged view of the exemplary on-screen user interface appearing in FIG. 8.

The distance to the target as determined using the rangefinder 1184 is output to the display 1068, e.g., as range to target indicia 1256 (see FIGS. 8 and 9). The distance to target for which the fire control system 1000 is currently set based on the rotational angle of the main body 1004 in relation to the base 1008 is displayed as an indicium 1258. The target setting distance displayed as the indicium 1258 scrolls though the target setting distance based on the angular information from the encoder 1228 as the main body 1004 is rotated. In operation, the user rotates the main body 1004 until the value displayed for the range indicium 1258 matches the distance as determined by the range finder and displayed as indicium 1256.

The selector switch 1080 is a rotary switch that allows the selection from among multiple pointing laser modes, e.g., laser selection and power level. The switch 1080 may also contain additional selections for available functions, ammunition type, etc. Indicia representative of the mode may be provided on the display 1068. For example, as shown in FIG. 9, an indicium 1260 depicts a "laser on" warning to the user. In certain embodiments, indicia 1262 representative of the battery level and 1264 representative of the camera optics zoom level are provided on the display 1068. Indicia representative of other information, as well as other configurations of display indicia, are also contemplated.

After the distance to the target is calculated by the range finder function, the processor 1172 performs a ballistics calculation to calculate the appropriate angle of trajectory of the weapon relative to the line of sight between the user and the target. The ballistics computation is made based on the trajectory data for the firearm or artillery with which the unit 1000 is being used. In certain embodiments, the trajectory data for the ballistics computer functionality may be provided for a particular type of firearm or artillery. Alternatively, trajectory data may be provided for a plurality of firearms or artilleries, for example stored in the memory 1180. The trajectory data for a desired one or more weapon types may be loaded from a computer based information handling system via the data port 1248. In certain embodiments, the ballistics computation is made based on the distance to the target and one or more environmental factors sensed using the environmental sensor module 1240.

Once the trajectory is calculated, the processor 1172 reads the encoder 1224 to allow rotating the main body 1004 with respect to the base 1008 so that the relative angle between the path of a selected one of the lasers 1204, 1208 (and thus the bore of the barrel of the weapon) is such that aligning an operative one of the lasers 1204, 1208 with the target will cause the weapon to be positioned at the proper angle for firing a projectile so that the path of the projectile will substantially intersect with the position of the target. In embodiments having a motorized drive system, the main body 1004 is rotated under control of the processor to the trajectory angle calculated trajectory angle.

A main reticle indicium 1268 is electronically overlaid on the display 1068 and represents an aim point that is bore sighted to the weapon 1064. A "disturbed" reticle indicium 1272 is also included to place a modified aim point that is calculated and overlaid onto the display 1068 based upon the weapon, munition, and environment. In certain embodiments, the disturbed reticle 1272 is a segmented crosshair reticle such that the right and left segments (1273, 1274) are solid (non-blinking) when the cant angle of the weapon is below an acceptable threshold angle relative to horizontal to indicate a cant angle within an acceptable range and to blink when the cant angle of the weapon exceeds the threshold angle, i.e., where the cant angle will adversely affect the trajectory of a projectile fired by the weapon. In certain embodiments, the cant angle control limits are dependent upon the range to target. In certain embodiments, the cant condition control limits allow a greater degree of cant the closer the target and a lesser degree of cant the further the target. In certain embodiments, the cant angle is determined by an accelerometer (not shown).

In certain embodiments, target recognition and comparison to an internally stored electronic library of targets can be utilized to identify the most advantageous round placement to the operator through an animated overlay on the display. The library of targets can be stored in the memory 1180 and uploaded via the data port 1248.

In certain embodiments, facial recognition of targets in the imaging field of view is provided, and photos transmitted, due to the high definition zoom camera, using the on-board video processor 1164. In certain embodiments, the program instructions stored in the memory 1180 includes facial recognition software which is executable on the processor 1164, and which may work in conjunction with the camera 1152 and/or wirelessly via the wireless interface 1220. The camera 1152 is operable to scan the faces, postures, etc. of persons appearing in the imaged target scene. The image data can be compared to a library of images stored in the memory 1180 and/or the image data can be transmitted via the wireless interface 1220 to a remote database or software application for facial recognition analysis.

Figure 11:
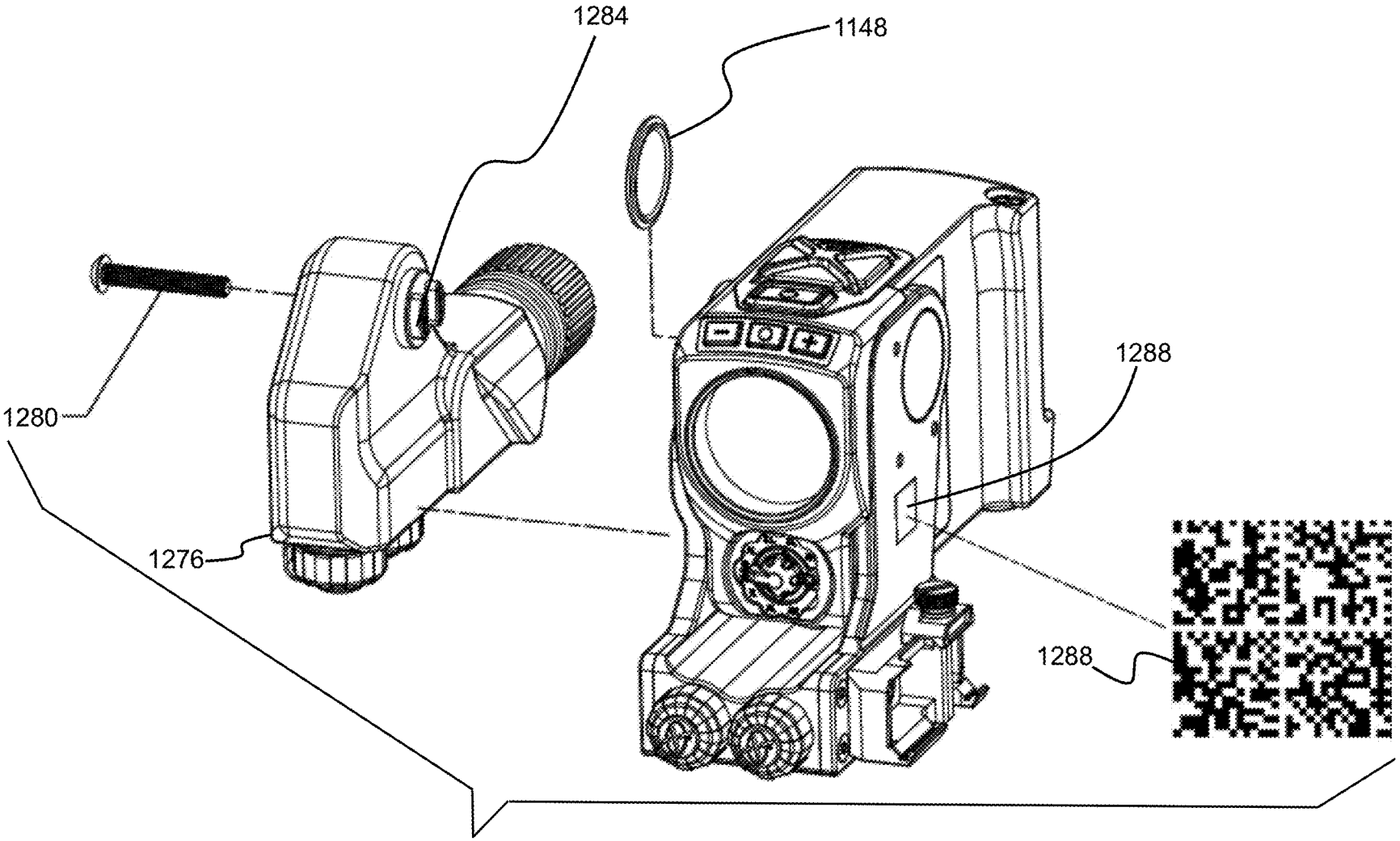
FIG. 11 illustrates an exemplary fire control system having an optional laser designator, which is advantageously used in connection with weapon systems firing laser guided munitions.
Figure 12:
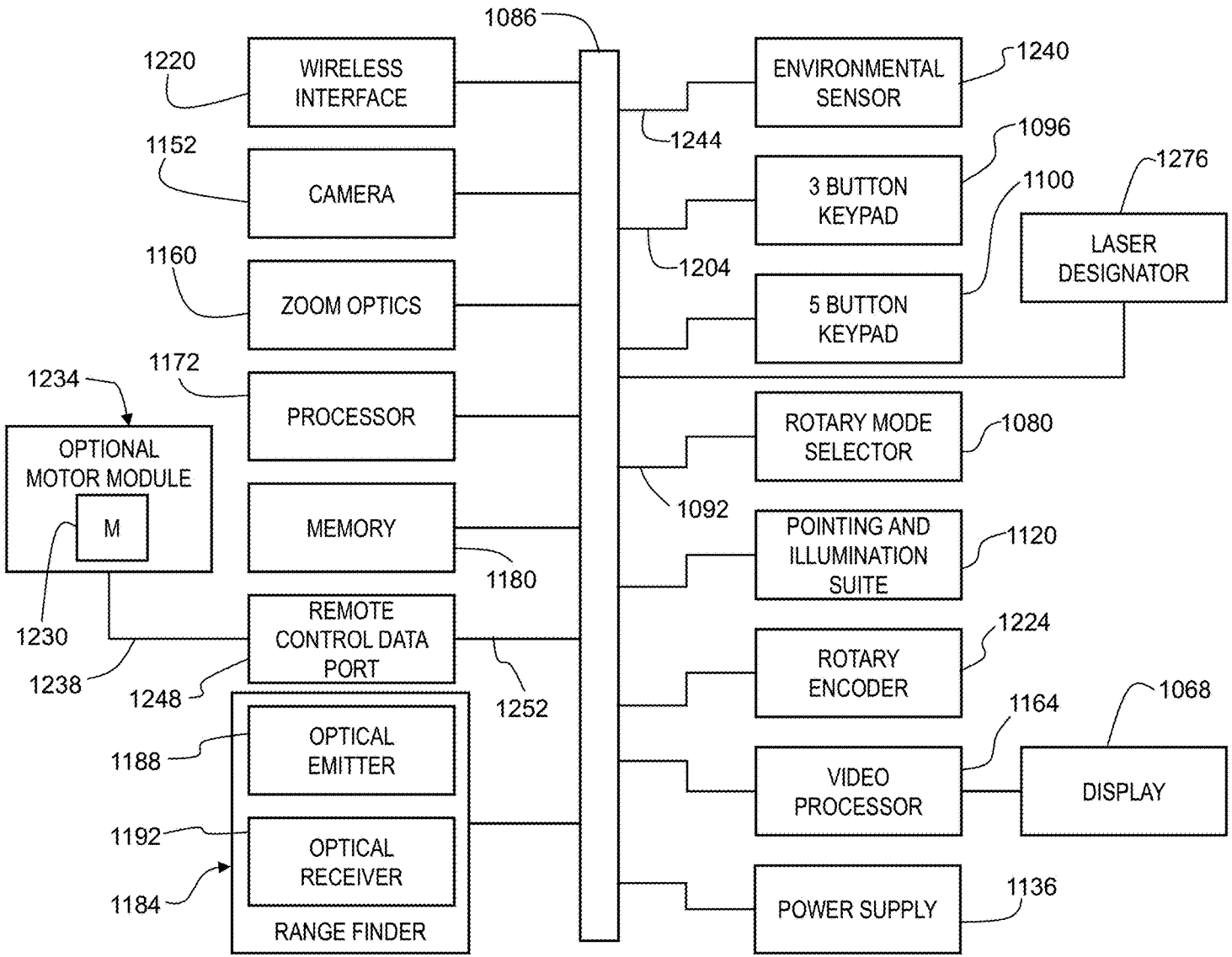
FIG. 12 is a functional block diagram of the fire control system herein.

Referring now to FIG. 11, in certain embodiments, the fire control system 1000 may include a laser designator module 1276. The laser designator module may be used in conjunction with a motor drive (see, e.g., FIG. 10), or without a motor drive unit wherein the pivoting of the main body 1004 is performed manually. In the illustrated embodiment, the laser designator module is coupled to the left pivot interface 1142 (with pivot cover 1148 removed) using a threaded fastener 1280. The laser designator 1276 pivots together with the main body 1004 via pivot drive interface 1284. The laser designator is advantageously used in connection with laser-guided weapon systems, such as a PIKE™ munition platform and others.

Control signals for activating the laser designator 1276 are also provided through the pivot interface assembly 1142 and a pivot drive interface 1284 on the designator. In operation, the laser designator module 1276 includes a laser emitter which emits a laser designator targeting beam for marking or "painting" a target. In certain embodiments, the designator targeting beam is a pulse-encoded beam. In certain embodiments, the laser designator beam is invisible to the naked eye. In certain embodiments, the laser designator beam is selected from a near infrared beam and an ultra violet beam. In certain embodiments, the designator beam has a wavelength of 1064 nm. In certain embodiments, the designator beam has a wavelength in the range of from about 900 nm to about 1000 nm.

In certain embodiments, an optional optically readable indicia 1288 is provided on the unit 1000. The optically readable indicia 1288 may be a 2D bar code or, more preferably, a 3D barcode, such as a QR code, or the like. When the indicia 1288 is scanned with a mobile device such as a smart phone, the mobile device will link to a web site such as the manufacturer's web site to allow the user to download an operator's manual for the fire control system 1000 and other pertinent information.

The invention has been described with reference to the preferred embodiments. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A fire control system, comprising:

a fixed base section having a fastener for providing a rigid connection of the fixed base section to a weapon;

a sight assembly rotatably attached to the fixed base section and rotatable about a transverse axis which extends in a direction which is generally transverse to a longitudinal axis of a barrel of the weapon;

the sight assembly including an optical range finder for calculating a distance to a selected target, the optical range finder including an optical emitter for sending an optical signal to the selected target and an optical detector for detecting the optical signal reflected from the selected target;

the sight assembly including a camera, the camera including a zoom lens assembly and an optical sensor, the camera configured to generate an image signal representative of a target scene including the selected target;

the zoom lens assembly including a zoom controller and zoom lens optical elements, the zoom controller configured to change a magnification of the zoom lens optical elements;

the sight assembly including a display configured to receive the image signal representative of the target scene and display a target scene image in human-viewable form;

a processor assembly including a processor and an associated computer readable memory encoded with executable instructions, the processor configured, upon execution of the executable instructions, to receive input representative of the distance to the selected target and calculate a trajectory angle of the weapon based on the distance to the selected target whereby the weapon will launch a projectile a distance that corresponds to the distance to the selected target when the barrel of the weapon is aligned with the trajectory angle; and the processor configured, upon execution of the executable instructions, to operate the zoom controller to change the magnification of the target scene image in proportion to a calculated distance to the selected target.

2. The fire control system of claim 1:

wherein the processor is configured, upon execution of the executable instructions, to operate the zoom controller to change the magnification of the target scene image to a maximum magnification level when the ranged target distance is greater than a first, upper threshold distance;

wherein the processor is configured, upon execution of the executable instructions, to operate the zoom controller to change the magnification of the target scene image to a minimum magnification level when the ranged target distance is less than a second, lower threshold distance; and wherein the processor is configured, upon execution of the executable instructions, to operate the zoom controller to change the magnification of the target scene image to a magnification level between the maximum and minimum magnification levels in direct proportion to the ranged target distance when the ranged target distance is between the first and second threshold distances.

3. The fire control system of claim 1, wherein the display is an organic light-emitting diode (OLED) display.

4. The fire control system of claim 1, wherein the sight assembly is rotatable between 0 and 45 degrees with respect to the fixed base portion.

5. The fire control system of claim 1, wherein the display is configured to overlay one or more indicia on the target scene image.

6. The fire control system of claim 5, wherein the one or more indicia is selected from the group consisting of: battery power indicia, range to target indicia, laser status indicia, reticle indicia, cant angle indicia, zoom magnification indicia, and any combination thereof.

7. The fire control system of claim 6, wherein the reticle indicia comprises one or both of a bore sight reticle which is bore sighted to the weapon and a disturbed reticle having a variable position which is automatically adjusted based on range and ballistics computations from the processor.

8. The fire control system of claim 1, wherein the fastener is selectively attachable to a left side of the fixed base portion and a right side of the fixed base portion.

9. The fire control system of claim 1, wherein the processor is configured to selectively store digital still images of the target scene in the memory.

10. The fire control system of claim 1, further comprising a communications interface.

11. The fire control system of claim 10, wherein the communications interface is selected from the group consisting of Bluetooth interface, B-Tac interface, and Wi-Fi interface.

12. The fire control system of claim 1, further comprising a library of target images stored in the memory and viewable on the display.

13. The fire control system of claim 1, further comprising facial recognition software stored in the memory and executable by the processor for recognizing persons appearing in the target scene image.

14. A method for imaging a target, comprising:

providing a fire control system, the fire control system comprising:

a fixed base section having a fastener for providing a rigid connection of the fixed base section to a weapon;

a sight assembly rotatably attached to the fixed base section and rotatable about a transverse axis which extends in a direction which is generally transverse to a longitudinal axis of a barrel of the weapon;

the sight assembly including an optical range finder for calculating a distance to a selected target, the optical range finder including an optical emitter for sending an optical signal to the selected target and an optical detector for detecting the optical signal reflected from the selected target;

the sight assembly including a camera, the camera including a zoom lens assembly and an optical sensor, the camera configured to generate an image signal representative of a target scene including the selected target;

the zoom lens assembly including a zoom controller and zoom lens optical elements, the zoom controller configured to change a magnification of the zoom lens optical elements;

the sight assembly including a display configured to receive the image signal representative of the target scene and display a target scene image in human-viewable form;

a processor assembly including a processor and an associated computer readable memory encoded with executable instructions, the processor configured, upon execution of the executable instructions, to receive input representative of the distance to the selected target and calculate a trajectory angle of the weapon based on the distance to the selected target whereby the weapon will launch a projectile a distance that corresponds to the distance to the selected target when the barrel of the weapon is aligned with the trajectory angle;

the processor configured, upon execution of the executable instructions, to operate the zoom controller to change the magnification of the target scene image in proportion to a calculated distance to the selected target;

calculating a distance to the target using the optical range finder;

capturing a target scene image using the camera;

generating a zoom control signal; and changing the magnification of the target scene image on the display in response to the distance to the target by controlling a position of the zoom optical elements in the zoom lens assembly.

15. The method of claim 14, further comprising:

rotating the sight assembly about the transverse axis with respect to the fixed base section by an angle which corresponds to the trajectory angle; and aligning an optical axis of the sighting assembly with the target to align the barrel of the weapon with the trajectory angle.

* * * * *